US007520386B1

(12) United States Patent
Griffin

(10) Patent No.: US 7,520,386 B1
(45) Date of Patent: Apr. 21, 2009

(54) SAW BLADE HOLDING AND STORAGE APPARATUS

(76) Inventor: Jeffrey M. Griffin, 4717 Ora St., Lansing, MI (US) 48910

( * ) Notice: Subject to any disclaimer, the term of this patent is extended or adjusted under 35 U.S.C. 154(b) by 232 days.

(21) Appl. No.: 11/516,252

(22) Filed: Sep. 6, 2006

(51) Int. Cl.
*B65D 85/802* (2006.01)
*A47F 7/00* (2006.01)

(52) U.S. Cl. ..... 206/372; 206/303; 206/445; 211/70.6

(58) Field of Classification Search ..... 206/349, 206/372, 454, 394, 477, 445, 303, 425, 309, 206/459, 45.34, 470; 220/529, 532, 533; 229/120.34, 120.38, 120.33; 211/41.1, 70.6
See application file for complete search history.

(56) References Cited

U.S. PATENT DOCUMENTS

| | | | | |
|---|---|---|---|---|
| D60,651 | S | 3/1922 | Farrington | |
| 2,697,460 | A | 12/1954 | Barnett | |
| 3,804,238 | A | 4/1974 | Howard | |
| 3,870,148 | A * | 3/1975 | Hite | 206/372 |
| 4,687,101 | A * | 8/1987 | Barker et al. | 206/308.3 |
| 4,921,153 | A * | 5/1990 | Smith | 224/683 |
| 4,927,016 | A * | 5/1990 | Fuller | 206/315.11 |
| 4,958,395 | A * | 9/1990 | Busskohl | 7/145 |
| 5,901,846 | A | 5/1999 | Betcher | |
| 5,927,493 | A | 7/1999 | Colombo | |
| D414,334 | S * | 9/1999 | Remington et al. | D3/276 |
| 6,068,272 | A | 5/2000 | Eskelinen | |
| 7,108,169 | B2 * | 9/2006 | Balzer | 229/67.1 |
| 2004/0217028 | A1 * | 11/2004 | Ploumitsakos | 206/349 |

* cited by examiner

*Primary Examiner*—Bryon P Gehman
*Assistant Examiner*—Ernesto A Grano

(57) ABSTRACT

A saw blade holding and storage apparatus includes a plurality of flexible pockets. Each of the flexible pockets has a back wall and a front wall joined along their bottom and lateral edges. Each of the pockets has a top edge having an opening extending therein and defining a primary opening. The pockets each have an approximately same width and height with respect to each other. The width of the pockets is a distance between the lateral edges. The plurality of pockets includes pockets having one or more sleeves configured for receiving at least one of a plurality of saw blades. Each of the sleeves includes lateral and bottom boundaries formed by attached portions of the front and back walls.

15 Claims, 7 Drawing Sheets

SAW BLADE HOLDING AND STORAGE APPARATUS

BACKGROUND OF THE INVENTION

1. Field of the Invention

The present invention relates to saw blade holders and more particularly pertains to a new saw blade holder for holding a plurality of saw blades in such a manner that the saw blades are easily retrieved and are protected from damaging each other.

2. Description of the Prior Art

The use of saw blade holders is known in the prior art. While these devices fulfill their respective, particular objectives and requirements, the need remains for a device that stores a plurality of saw blades in such a manner that they do not damage each other while they are being stored. The device should include means for holding saw blades of different sizes. Further, the device should allow for easy retrieval of the saw blades and means for vertically supporting the saw blades.

SUMMARY OF THE INVENTION

The present invention meets the needs presented above by generally comprising a plurality of flexible pockets. Each of the flexible pockets has a back wall and a front wall joined along their bottom and lateral edges. Each of the pockets has a top edge having an opening extending therein and defining a primary opening. The pockets each have an approximately same width and height with respect to each other. The width of the pockets is a distance between the lateral edges. The plurality of pockets includes pockets having one or more sleeves configured for receiving at least one of a plurality of saw blades.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
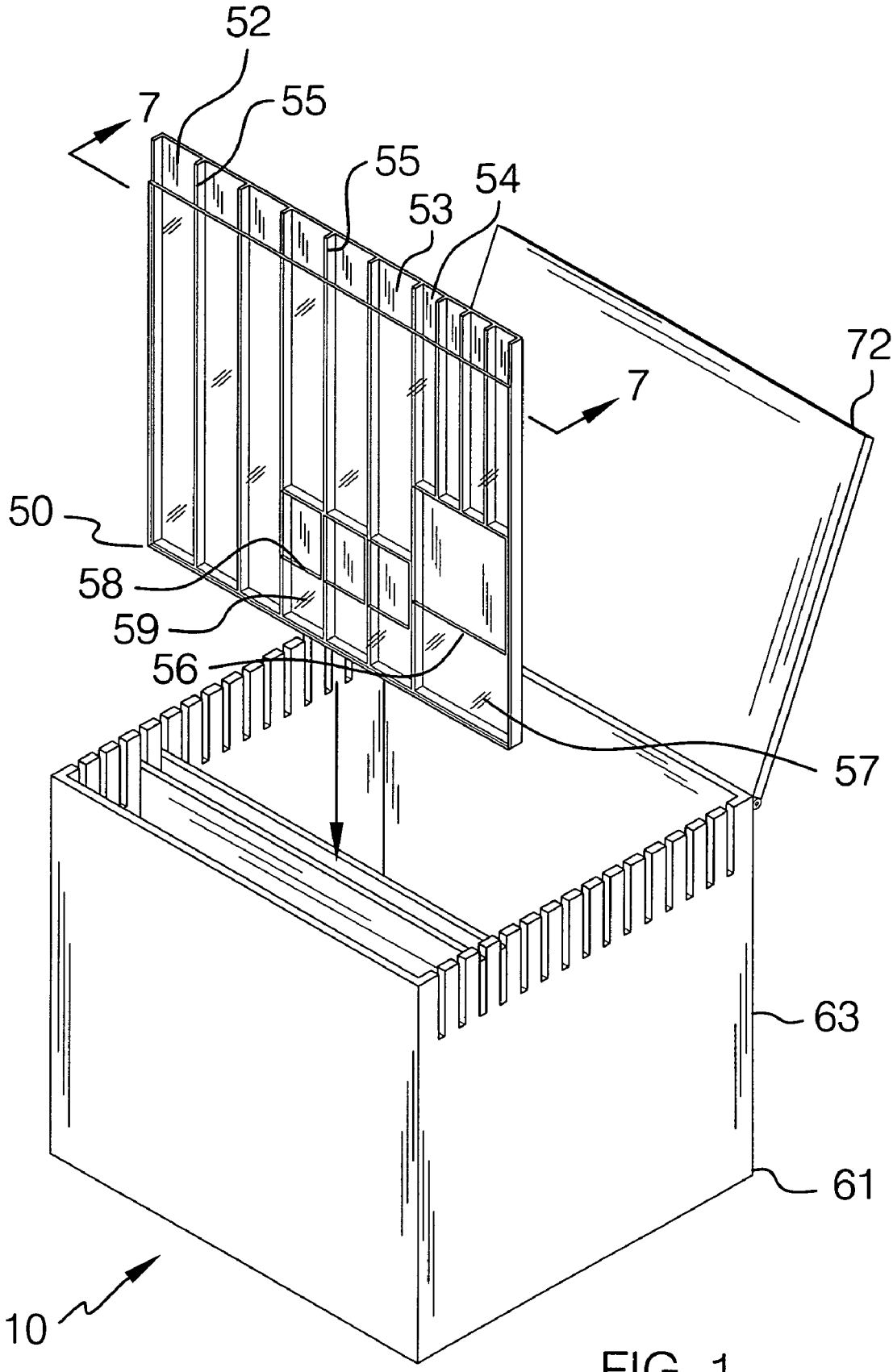
FIG. 1 is a perspective view of a saw blade holding and storage apparatus according to the present invention.
Figure 2:
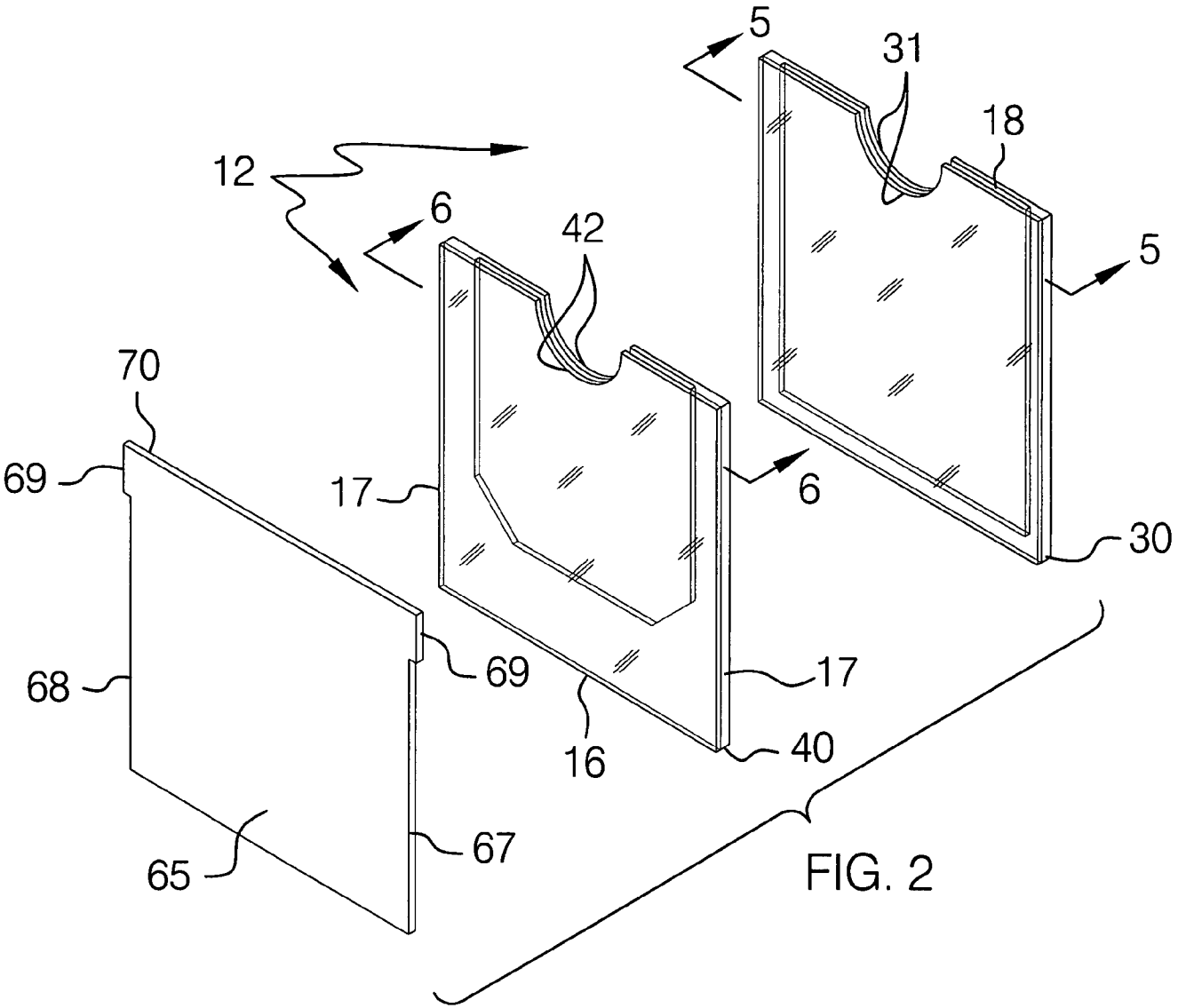
FIG. 2 is a perspective view of a plurality of pockets of the present invention.
Figure 3:
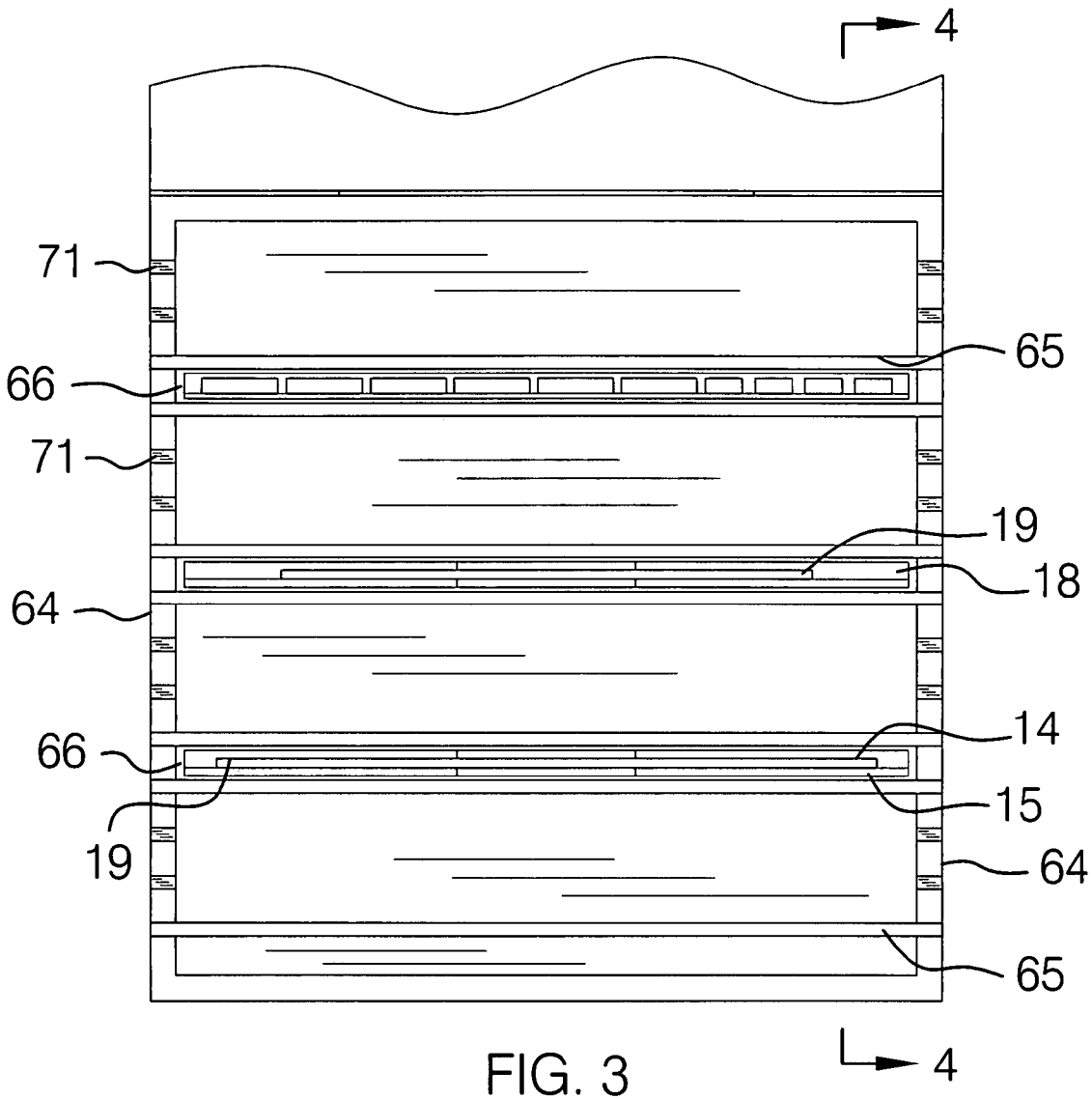
FIG. 3 is a top view of a housing of the present invention.
Figure 4:
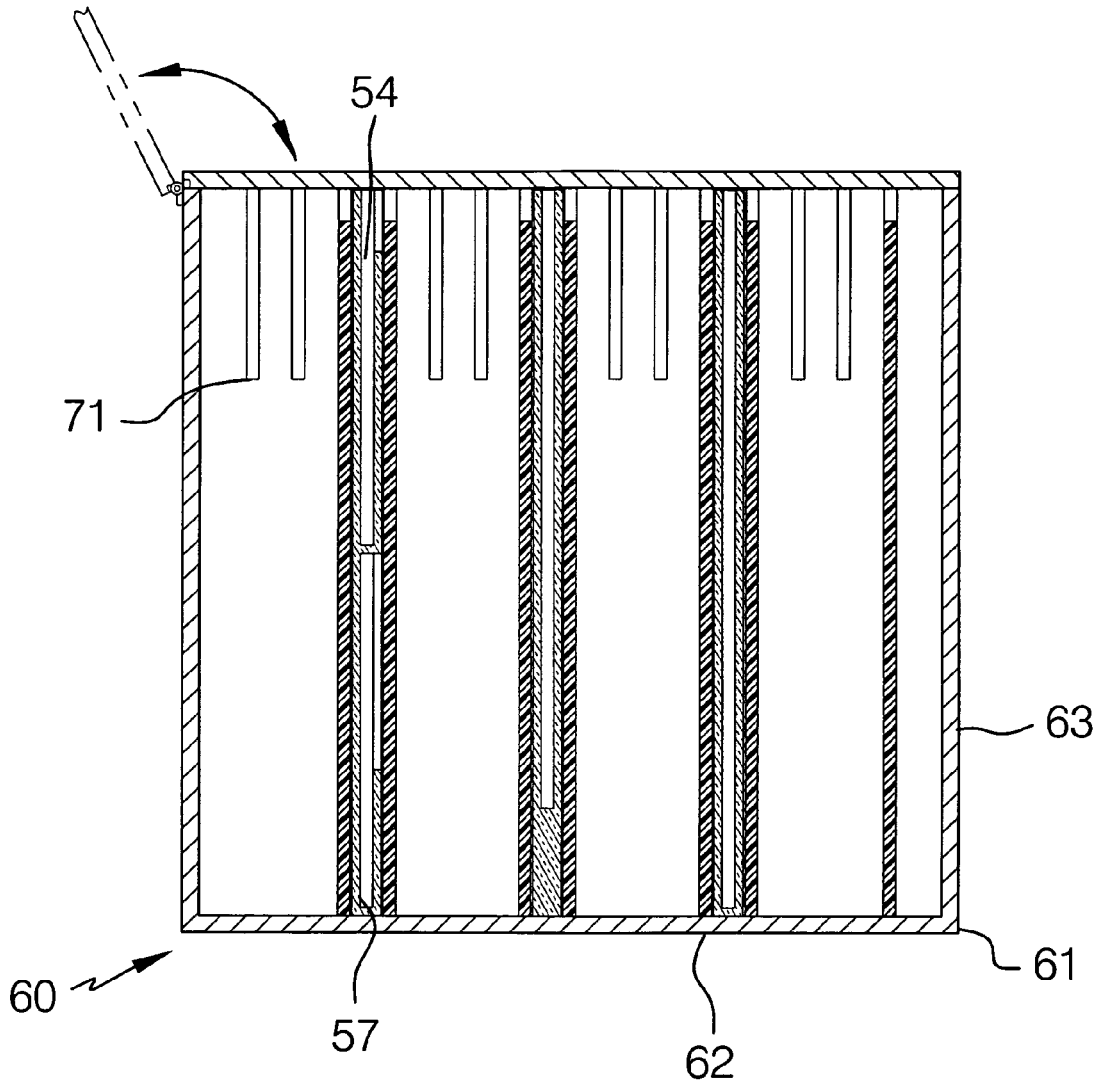
FIG. 4 is a cross-sectional view taken along line 4-4 of FIG. 3 of the present invention.
Figure 5:
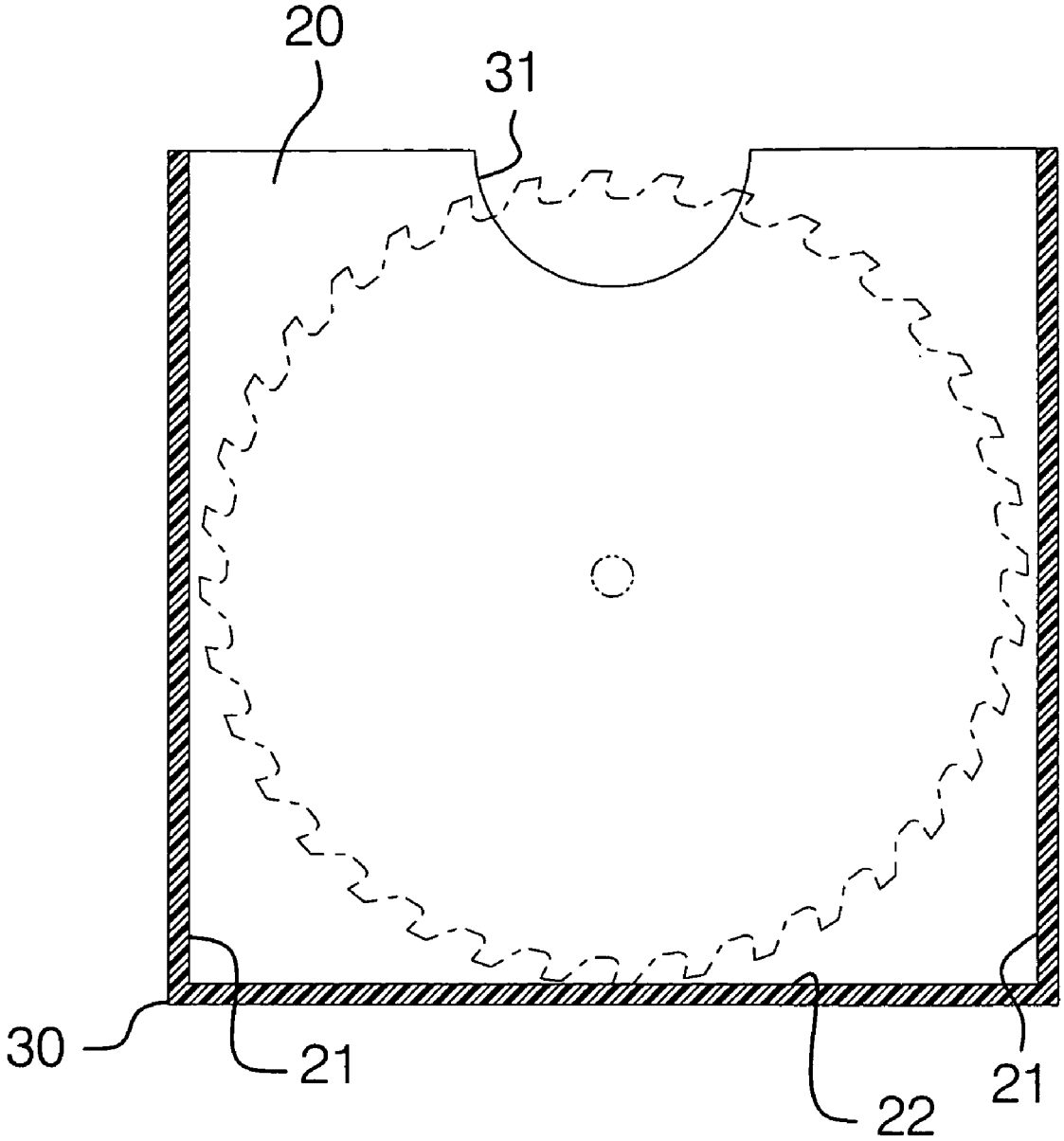
FIG. 5 is a cross-sectional view taken along line 5-5 of FIG. 2 of the present invention.
Figure 6:
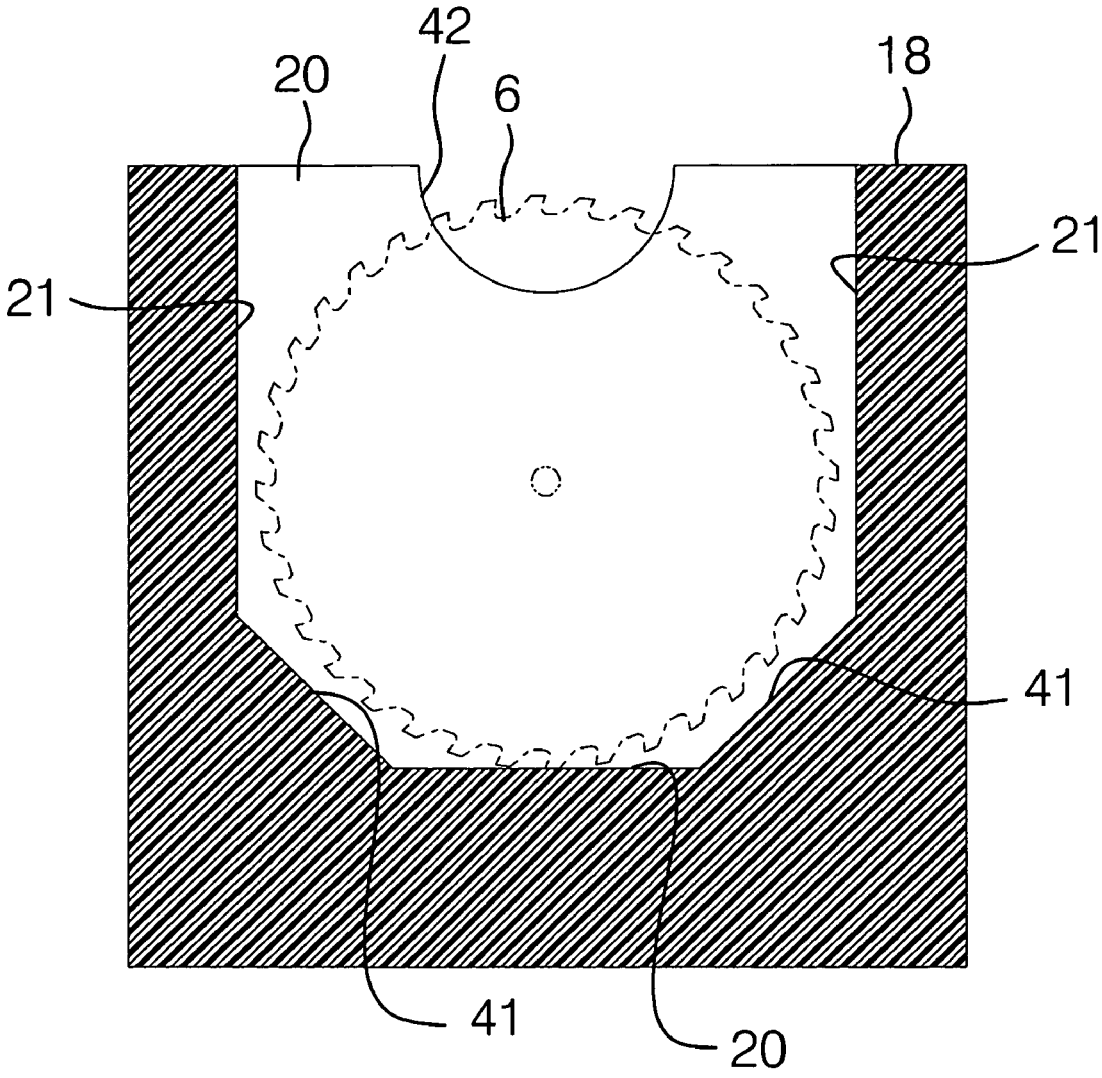
FIG. 6 is a cross-sectional view taken along line 6-6 of FIG. 2 of the present invention.
Figure 7:
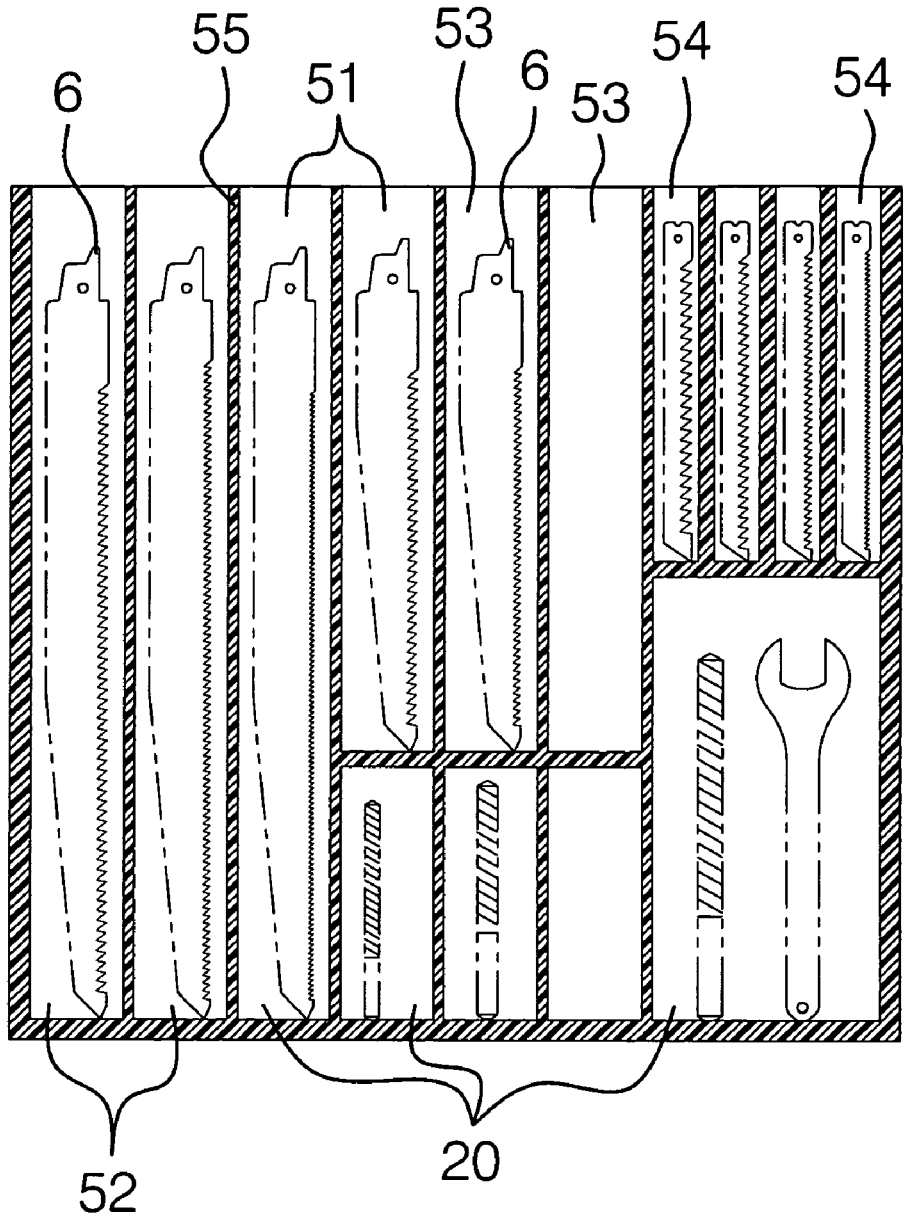
FIG. 7 is a cross-sectional view taken along line 7-7 of FIG. 1 of the present invention.

With reference now to the drawings, and in particular to FIGS. 1 through 7 thereof, a new saw blade holder embodying the principles and concepts of the present invention and generally designated by the reference numeral 10 will be described.

As best illustrated in FIGS. 1 through 7, the saw blade 6 holding and storage apparatus 10 generally comprises a plurality of flexible pockets 12 that may be comprised of a plastic material. The pockets 12 may be transparent to easily view the interiors of the pockets. Each of the flexible pockets 12 has a back wall 14 and a front wall 15 joined along their bottom 16 and lateral edges 17. The pockets 12 each have a top edge 18 having an opening extending therein and defining a primary opening 19. Each of the pockets 12 has an approximately same width and height with respect to each other. The width of the pockets 12 is a distance between the lateral edges 17. The width and height may each be between 10 inches and 12 inches. Each of the pockets 12 includes one or more sleeves 20 configured for receiving at least one of a plurality of saw blades 6. Each of the sleeves 20 includes lateral 21 and bottom 22 boundaries formed by attached portions of the front 15 and back 14 walls. The pockets 12 preferably have different sleeves 20 having different sizes for holding different sized saw blades 6. The pockets 12 may include large blade pockets 30, medium blade pockets 40 and combination blade pockets 50.

The large blade pockets 30 each have a single one of the sleeves 20 having an inner width and height configured for at least receiving a 10 inch circular saw blade 6. The sleeves 20 of the large blade pockets 30 have an inner height and width greater than 10 inches. The top edges 18 of the front 15 and back 14 walls of the large blade pockets 30 have aligned notches 31 therein to facilitate removal of a saw blade 6 from the large blade pockets 30.

The medium blade pockets 40 also have a single one of the sleeves 12 having an inner width and height configured for receiving an 8 inch circular saw blade 6. The sleeve 12 of the medium blade pocket 40 has an inner height and width each between 8 inches and 8.5 inches. A lower portion 41 of each of the lateral boundaries 21 is angled with respect to the bottom boundary 22 to better fit the smaller saw blade 6. The top edges 18 of the front 15 and back 14 walls of the medium blade pockets 40 have aligned notches 42 therein to facilitate removal of a saw blade 6 from the medium blade pockets 40.

The combination blade pockets 50 having a plurality of sleeves therein 20 that are elongated sleeves 51 each extending toward the bottom edges 16. Each of the elongated sleeves 51 has a width between than 1 inch and 3 inches. The elongated sleeves 51 include at least one full length sleeve 52 having an inner height greater than 8 inches and a width between 1 inch and 2 inches. The elongated sleeves 51 include at least one intermediate length sleeve 53 that has an inner height between 5 inches and 6 inches measured from the top edge 18 of the front wall 15 to the bottom boundary 20 of the at least one intermediate length sleeve 53, and a width between 1 inch and 2 inches. The elongated sleeves 51 also include at least one short length sleeve 54 that has an inner height between 2 inches and 3 inches measured from the top edge 18 of the front wall 15 to the bottom boundary 20 of the at least one short length sleeve 54, and a width less than 1 inch. The top edge 18 of the front wall 15 is vertically positioned below the top edge 18 of the back wall 14 to facilitate removal of a saw blade 6 from the combination blade pocket 50 which might be placed in the full length 52, intermediate length 53 and short length 54 sleeves. Seams 55 of the elongated sleeves 51 however preferably extend upwardly to the top edge 18 of the back wall 14 to allow for easier of insertion of blades 6 into the sleeves 51 of the combination blade pockets 50. The primary opening 19 forms the opening into each of the elongated sleeves 51.

Further, the front wall 15 of the combination blade pockets 50 have at least one opening 56 therein positioned beneath the at least one short length sleeve 54 and opening into at least one lower sleeve 57 positioned beneath the at least one short length sleeve 54. The front wall 15 may also have at least one opening 58 therein positioned beneath the at least one intermediate length sleeve 53 and opening into at least one bottom sleeve 59 positioned beneath the at least one intermediate length sleeve 53.

A storage assembly 60 has an upper side that is open and receives each of the pockets 12. The storage assembly 60 is configured to support each of the pockets 12 in a vertical orientation. The storage assembly 60 includes a housing 61 having a bottom wall 62 and a peripheral wall 63 that is attached to and extends upwardly from the bottom wall 62. The housing 61 includes a pair of side walls 64. A distance between the side walls 64 is approximately equal to a width of the pockets 12. A plurality of dividing walls 65 extends between the side walls 64. Slots 66 are defined between adjacent ones of the dividing walls 65. Each of the pockets 12 is positionable in one of the slots 66. The dividing walls 65 each have a first side edge 67 and a second side edge 68. The diving walls 65 are selectively removable from the housing 61. A plurality of tabs 69 is provided. Two of the tabs 69 are attached to each of the dividing walls 65 so that each of the first 67 and second 68 side edges has one of the tabs 69 attached thereto. The tabs 69 are positioned adjacent to an upper edge 70 of a respective one of the dividing walls 65. Each of the tabs 69 is extendable into one of a plurality of slits 71 downwardly extending into the each of the side walls 64. The dividing walls 65 may be moved, as needed to make room for additional pockets or to form slots 66 for holding other tools or attachments. A cover 72 may be hingedly mounted on the housing 61 to close the housing 61.

In use, the user of the apparatus 10 places saw blades 6 into the sleeves 20, which are sized for the particular saw blades 10. The large 30 and medium 40 blade pockets are particularly well suited for holding circular blades while the combination blade pocket 50 is configured to hold elongated blades such as jig saw blades and other reciprocal saw devices. The pockets 12 retain the saw blades 6 in an orderly configuration while preventing the saw blades 6 from contacting each other.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A saw blade holding apparatus configured for holding and storing a plurality of saw blades having different sizes, said apparatus comprising:

a plurality of flexible pockets, each of said flexible pockets having a back wall and a front wall joined along their bottom and lateral edges, each of said pockets having a top edge having an opening extending therein and defining a primary opening, each of said pockets having an approximately same width and height with respect to each other, said width of said pockets being a distance between said lateral edges, each of said plurality of pockets including one or more sleeves configured for receiving at least one of the saw blades, each of said sleeves including lateral and bottom boundaries formed by attached portions of said front and back walls;

said plurality of pockets including at least one combination blade pocket having a plurality of elongated sleeves therein extending toward said bottom edges, said elongated sleeves of said at least one combination blade pocket including at least one full length sleeve, said elongated sleeves of said at least one combination blade pocket including at least one intermediate length sleeve having an inner height less than an inner height of said full length sleeve measured from said top edge of said front wall to said bottom boundary of said at least one intermediate length sleeve, said elongated sleeves of said at least one combination blade pocket including at least one short length sleeve having an inner height less than said inner height of said at least one intermediate length sleeve measured from said top edge of said front wall to said bottom boundary of said at least one short length sleeve, said front wall of said at least one combination blade pocket having at least one opening therein positioned beneath said at least one short length sleeve and opening into at least one lower sleeve positioned beneath said at least one short length sleeve, said front wall of said at least one combination blade pocket having at least one opening therein positioned beneath said at least one intermediate length sleeve and opening into at least one bottom sleeve positioned beneath said at least one intermediate length sleeve.

2. The apparatus according to claim 1, further including a storage assembly having an upper side being open and receiving each of said pockets, said storage assembly being configured to support each of said pockets in a vertical orientation.

3. The apparatus according to claim 2, wherein said storage assembly includes:

a housing including a bottom wall and a peripheral wall being attached to and extending upwardly from said bottom wall, said housing including a pair of side walls, a distance between said side walls being approximately equal to a width of said pockets;

a plurality of dividing walls extending between said side walls, slots being defined between adjacent ones of said dividing walls, each of said pockets being positionable in one of said slots, said dividing walls each having a first side edge and a second side edge.

4. The apparatus according to claim 3, wherein each of said diving walls may be selectively removed from said housing, said storage assembly further including a plurality of tabs, two of said tabs being attached to each of said dividing walls wherein each of said first and second side edges has one of said tabs attached thereto, said tabs being positioned adjacent to an upper edge of a respective one of said dividing walls, each of said tabs being extendable into one of a plurality of slits downwardly extending into each of said side walls.

5. The apparatus according to claim 1, wherein said plurality of pockets includes at least one large blade pocket having a single one of said sleeves having an inner width and height configured for at least receiving a 10 inch circular saw blade.

6. The apparatus according to claim 5, wherein said sleeve of said at least one large blade pocket has an inner height and width greater than 10 inches.

7. The apparatus according to claim 5, wherein said top edges of said front and back walls of said at least one large blade pocket having aligned notches therein to facilitate removal of a saw blade from said at least one large blade pocket.

8. The apparatus according to claim 5, wherein said plurality of pockets includes at least one medium blade pocket having a single one of said sleeves having an inner width and height configured for receiving an 8 inch circular saw blade.

9. The apparatus according to claim 8, wherein said plurality of pockets includes at least one combination blade pocket having a plurality of elongated sleeves therein extending toward said bottom edges, each of said elongated sleeves having a width between than 1 inch and 3 inches.

10. The apparatus according to claim 9, wherein said plurality of elongated sleeves in said at least one said combination blade pocket including sleeves having a different height.

11. The apparatus according to claim 9, further including a storage assembly having an upper side being open and receiving each of said pockets, said storage assembly being configured to support each of said pockets in a vertical orientation.

12. The apparatus according to claim 1, wherein said plurality of pockets includes at least one medium blade pocket having a single one of said sleeves having an inner width and height configured for receiving an 8 inch circular saw blade.

13. The apparatus according to claim 12, wherein said sleeve of said at least one medium blade pocket has an inner height and width each between 8 inches and 8.5 inches.

14. The apparatus according to claim 13, wherein said top edges of said front and back walls of said at least one medium blade pocket having aligned notches therein to facilitate removal of a saw blade from said at least one medium blade pocket.

15. A saw blade holding apparatus configured for holding and storing a plurality of saw blades having different sizes, said apparatus comprising:

a plurality of flexible pockets, each of said flexible pockets having a back wall and a front wall joined along their bottom and lateral edges, each of said pockets having a top edge having an opening extending therein and defining a primary opening, each of said pockets having an approximately same width and height with respect to each other, said width of said pockets being a distance between said lateral edges, each of said pockets including one or more sleeves configured for receiving at least one of said blades, each of said sleeves including lateral and bottom boundaries formed by attached portions of said front and back walls, said plurality of pockets including:

at least one large blade pocket having a single one of said sleeves having an inner width and height configured for at least receiving a 10 inch circular saw blade, said sleeve of said at least one large blade pocket having an inner height and width greater than 10 inches, said top edges of said front and back walls having aligned notches therein to facilitate removal of a saw blade from said at least one large blade pocket;

at least one medium blade pocket having a single one of said sleeves having an inner width and height configured for receiving an 8 inch circular saw blade, said sleeve of said at least one medium blade pocket having an inner height and width each between 8 inches and 8.5 inches, a lower portion of said lateral boundaries being angled with respect to said bottom boundary, said top edges of said front and back walls having aligned notches therein to facilitate removal of a saw blade from said at least one medium blade pocket;

at least one combination blade pocket having a plurality of elongated sleeves therein extending toward said bottom edges, each of said elongated sleeves having a width between than 1 inch and 3 inches, said elongated sleeves including at least one full length sleeve having an inner height greater than 8 inches, said elongated sleeves including at least one intermediate length sleeve having an inner height between 5 inches and 6 inches measured from said top edge of said front wall to said bottom boundary of said at least one intermediate length sleeve, said elongated sleeves including at least one short length sleeve having an inner height between 2 inches and 3 inches measured from said top edge of said front wall to said bottom boundary of said at least one short length sleeve, said front wall having at least one opening therein positioned beneath said at least one short length sleeve and opening into at least one lower sleeve positioned beneath said at least one short length sleeve, said front wall having at least one opening therein positioned beneath said at least one intermediate length sleeve and opening into at least one bottom sleeve positioned beneath said at least one intermediate length sleeve, said top edge of said front wall being vertically positioned below said top edge of said back wall to facilitate removal of a saw blade from said combination blade pocket;

a storage assembly having an upper side being open and receiving each of said pockets, said storage assembly being configured to support each of said pockets in a vertical orientation, said storage assembly including:

a housing including a bottom wall and a peripheral wall being attached to and extending upwardly from said bottom wall, said housing including a pair of side walls, a distance between said side walls being approximately equal to a width of said pockets;

a plurality of dividing walls extending between said side walls, slots being defined between adjacent ones of said dividing walls, each of said pockets being positionable in one of said slots, said dividing walls each having a first side edge and a second side edge, each of said diving walls being selectively removable from said housing; and a plurality of tabs, two of said tabs being attached to each of said dividing walls wherein each of said first and second side edges has one of said tabs attached thereto, said tabs being positioned adjacent to an upper edge of a respective one of said dividing walls, each of said tabs being extendable into one of a plurality of slits downwardly extending into each of said side walls.

* * * * *